US005592788A

United States Patent [19]

Corridon

[11] Patent Number: 5,592,788

[45] Date of Patent: Jan. 14, 1997

[54] CATHEDRAL CEILING FIXTURE MOUNTING SYSTEM

[76] Inventor: James M. Corridon, 4929 Tibbitt La., Burke, Va. 22015

[21] Appl. No.: 242,231

[22] Filed: May 13, 1994

[51] Int. Cl.[6] ..... E04F 19/00

[52] U.S. Cl. ..... 52/39; 52/730.7; 248/342; 362/147

[58] Field of Search ..... 52/28, 39, 57, 52/127.1, 198, 199, 219, 606, 607, 608, 730.1, 730.7, 287.1, 288.1, 27; 362/147, 148, 150, 151, 152, 404; 248/342, 343, 344, 220.1; 144/13

[56] References Cited

U.S. PATENT DOCUMENTS

| | | | |
|---|---|---|---|
| 917,324 | 4/1909 | Loving | 52/288.1 |
| 1,269,674 | 6/1918 | Bacigalupo | 52/608 |
| 2,032,030 | 2/1936 | Talen | 52/592.3 |
| 2,627,016 | 1/1953 | Hollinger | 362/147 |
| 2,651,086 | 9/1953 | Corson | 52/288.1 |
| 3,291,298 | 12/1966 | McCue | 52/57 |
| 4,890,427 | 1/1990 | Rayburn | 52/90.2 |
| 5,090,654 | 2/1992 | Ridings et al. . | |
| 5,179,811 | 1/1993 | Walker et al. | 52/288.1 |

FOREIGN PATENT DOCUMENTS

| | | | |
|---|---|---|---|
| 2581112 | 10/1986 | France | 52/90.2 |
| 524965 | 8/1940 | United Kingdom | 52/287.1 |

*Primary Examiner*—Michael Safavi
*Attorney, Agent, or Firm*—Nies, Kurz, Bergert & Tamburro

[57] ABSTRACT

A fixture mount for providing a flush surface adjacent the ridge of a cathedral ceiling at the position where a ceiling fan or light fixture is to be supported is disclosed. The fixture mount is capable of fitting any common cathedral ceiling pitch and allows the user to mount a ceiling fan or fixture in a location such as the center of a room in an aesthetically pleasing manner. The fixture mount can be formed as a monolithic member or, alternatively, with a base mount member and one or more pitch mount members stacked sequentially, with each successive pitch mount varying the pitch of the fixture mount such that, when the pitch of a particular cathedral ceiling is known, the fixture mount of the present invention can be readily modified to correspond to the pitch of the ceiling.

10 Claims, 5 Drawing Sheets

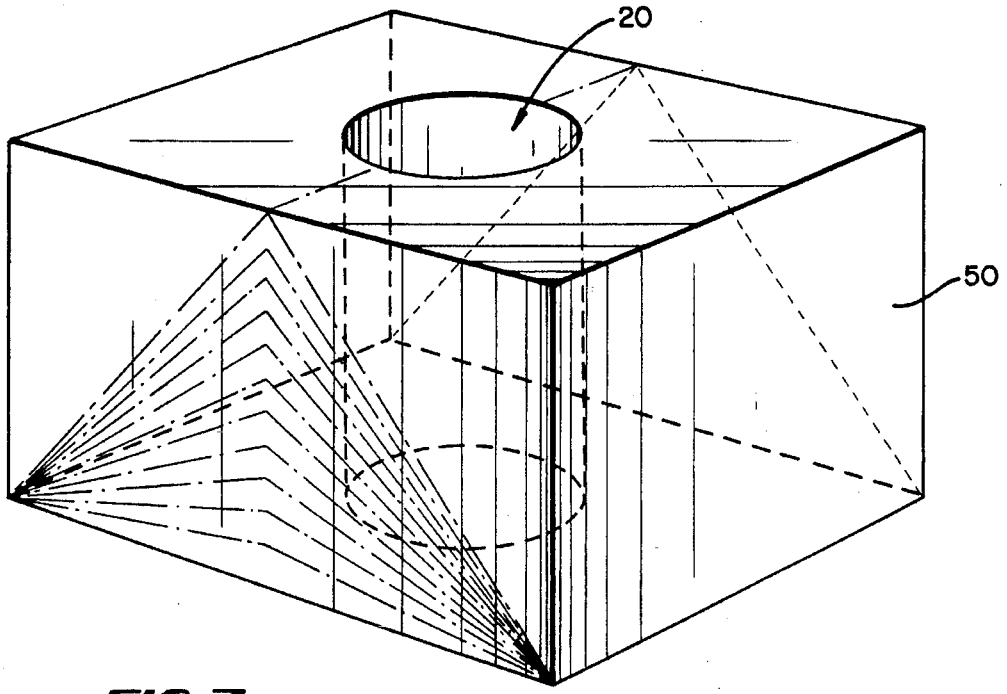
FIG. 7
FIG. 8
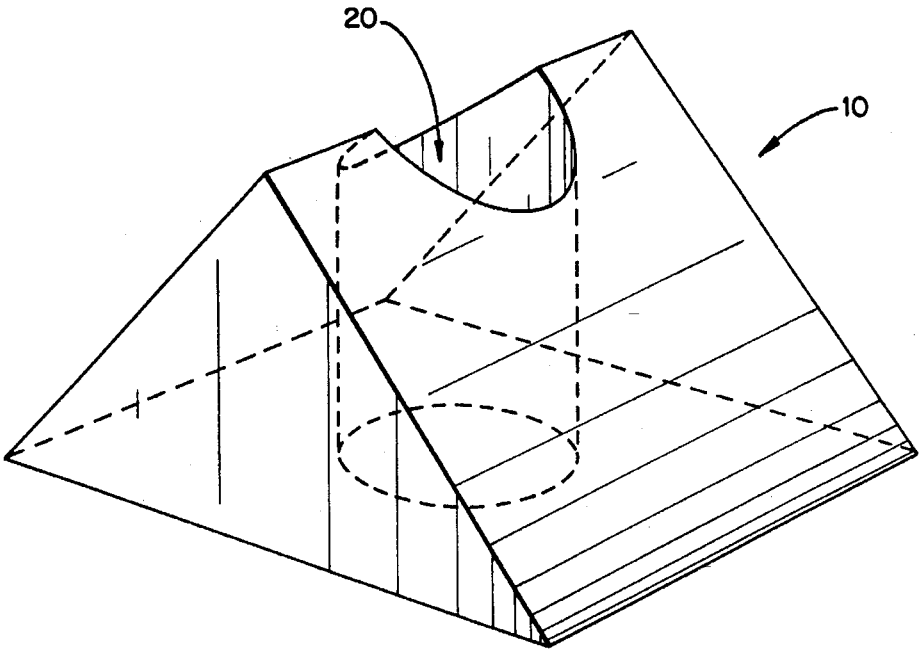

CATHEDRAL CEILING FIXTURE MOUNTING SYSTEM

BACKGROUND AND SUMMARY OF THE INVENTION

The present invention relates to the mounting of ceiling fixtures and more particularly to an apparatus for providing a flat horizontal mounting surface at the ridge of a cathedral ceiling whereby a light fixture or ceiling fan hanging from such a ceiling will have its less aesthetic components such as electrical wiring hidden from view.

Traditionally, ceiling fans and light fixtures have been mounted to flat ceilings by suspending the fan or fixture from a bracket attached to a beam in the ceiling in a position approximating the center of the room. A canopy or boot is then placed over the wiring box which houses the electrical wiring supplying the current to the fixture, so as to cover the electrical circuitry and provide an aesthetically pleasing appearance to the area adjacent the fixture.

Unfortunately, for those desiring to mount their fan or lighting fixture in the center of a room with a cathedral ceiling, the steep angles of cathedral ceilings have presented several problems. Since a cathedral ceiling does not have a flat surface, an unattractive gap is created between the fixture and the ridge of the ceiling. Some efforts, such as U.S. Pat. No. 5,090,654, for example, have avoided this problem altogether by mounting the fixture to one of the sloped edges of the cathedral ceiling. However, this often appears awkward and does not allow for fixture placement in the center of the room. Other efforts seeking to remedy this problem have involved constructing a flat surface out of typical framing material, then preparing, installing, and painting drywall or a similar finishing surface to the constructed frame. This method is impractical because it requires simultaneous construction with the cathedral ceiling, it is not removable and adaptable elsewhere, and it does not allow for practical placement of a design to be viewed from the floor.

In accordance with the present invention, there is provided a flush mounting apparatus which allows typical ceiling fans and light fixtures to be mounted to the ridge of cathedral ceilings of varying pitch in an aesthetically pleasing manner.

It is thus one object of the present invention to provide a flush surface at the ridge of a cathedral ceiling where a light fixture or ceiling fan is mounted.

It is another object of the present invention to provide a flush surface at the ridge of a cathedral ceiling where a light fixture or ceiling fan is mounted and wherein the flush surface can be added after construction of the ceiling is complete.

It is a further object of the present invention to provide a flat or planar horizontal mounting surface for use in mounting a light fixture or ceiling fan in the center of a room having a cathedral or vaulted ceiling.

It is yet another object of the present invention to provide the user with an apparatus for easily filling the pitch of the intended cathedral ceiling slope without having to know the exact pitch.

It is still another object of the present invention to provide an apparatus for filling the pitch of a cathedral ceiling whereby a light fixture or ceiling fan or other fixture can be easily mounted at whatever pitch angle is encountered in a particular ceiling construction.

It is a further object of the present invention to provide a flat surface for fixture mounting to a cathedral ceiling and wherein the flat surface may include a design.

BRIEF DESCRIPTION OF THE DRAWINGS

FIG. 7 is a perspective view of an embodiment in which a solid block piece is used in forming the apparatus of the present invention with a cylindrical center opening or bore and with available pitch cut angles shown in phantom.

FIG. 8 is a perspective view of a previously cut solid block piece of FIG. 7 with a center bore.

DESCRIPTION OF THE PREFERRED EMBODIMENTS

Figure 1:
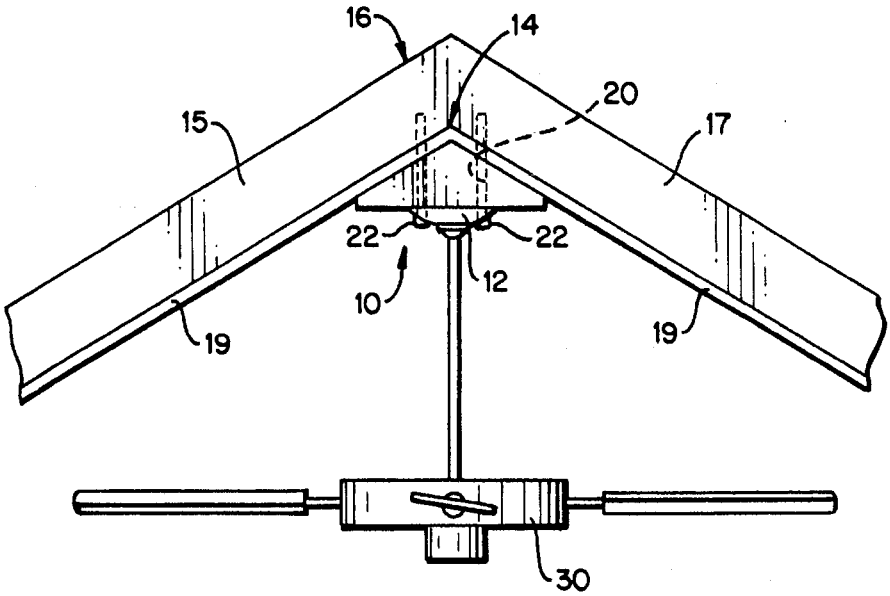
FIG. 1 is a front elevation showing the present invention installed with a ceiling fan in a cathedral ceiling.
Figure 2:
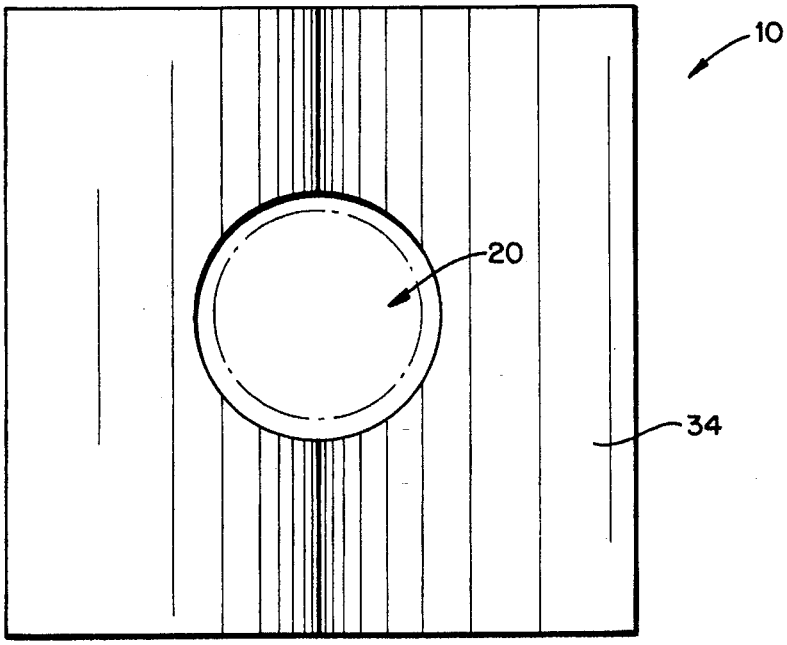
FIG. 2 is a bottom plan view of the apparatus of the present invention.
Figure 5:
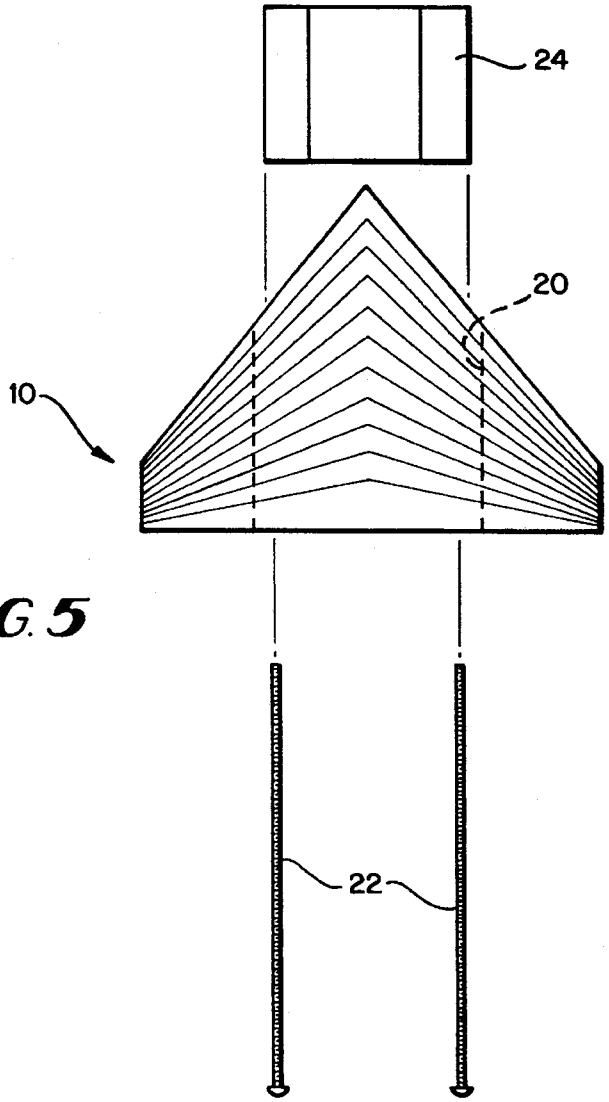
FIG. 5 shows an exploded front view of the apparatus of the present invention with standard screws connecting the apparatus to a standard workbox.

In the embodiment of the invention as shown in FIGS. 1 and 2, there is provided a cathedral ceiling fixture mount 10 for placement between a typical fan or lighting fixture boot 12 and the apex 14 of a cathedral ceiling 16. The ceiling 16 may, for example, be formed of a series of rafters or truss members 15, 17 having a drywall layer 19 secured thereto. The fixture mount 10 is provided with a central vertical opening or bore 20. This central bore 20 allows for secure placement of the fixture mount 10 between the fixture boot 12 and the ceiling 16, employing screws 22 or other securing members which pass through the fixture boot 12 and the center bore 20 and firmly engage a standard ceiling workbox 24, as shown in FIG. 5, which has been previously secured to the truss members 15, 17. Thus the ceiling 16, and not the fixture mount 10, bears the load of the ceiling fan or fixture 30. The central bore 20 also allows for the connection of necessary electrical wiring from the ceiling workbox 24 to the ceiling fan or fixture 30.

In the embodiment of the invention as shown in FIGS. 7 and 8, the fixture mount 10 is made of a single pre-cut solid piece having a central bore 20 and a flat, horizontal bottom surface 34 suitable for painting or other decoration to be viewed from below. The material of the solid piece could be a rigid foam material, such as polyurethane, for example, which can be easily cut to the desired shape. This embodiment of the invention benefits the user who already knows the pitch or dimensions of the cathedral ceiling 16 and desires a one piece embodiment pre-cut to the user's desired pitch angle. This one-piece embodiment may also be cut by the user to any desired pitch angle from a single block piece 50 having a center opening or bore 20, and with indicia on the block to indicate various pitch angles which may be cut, as illustrated by the phantom lines in FIG. 7.

Figure 3:
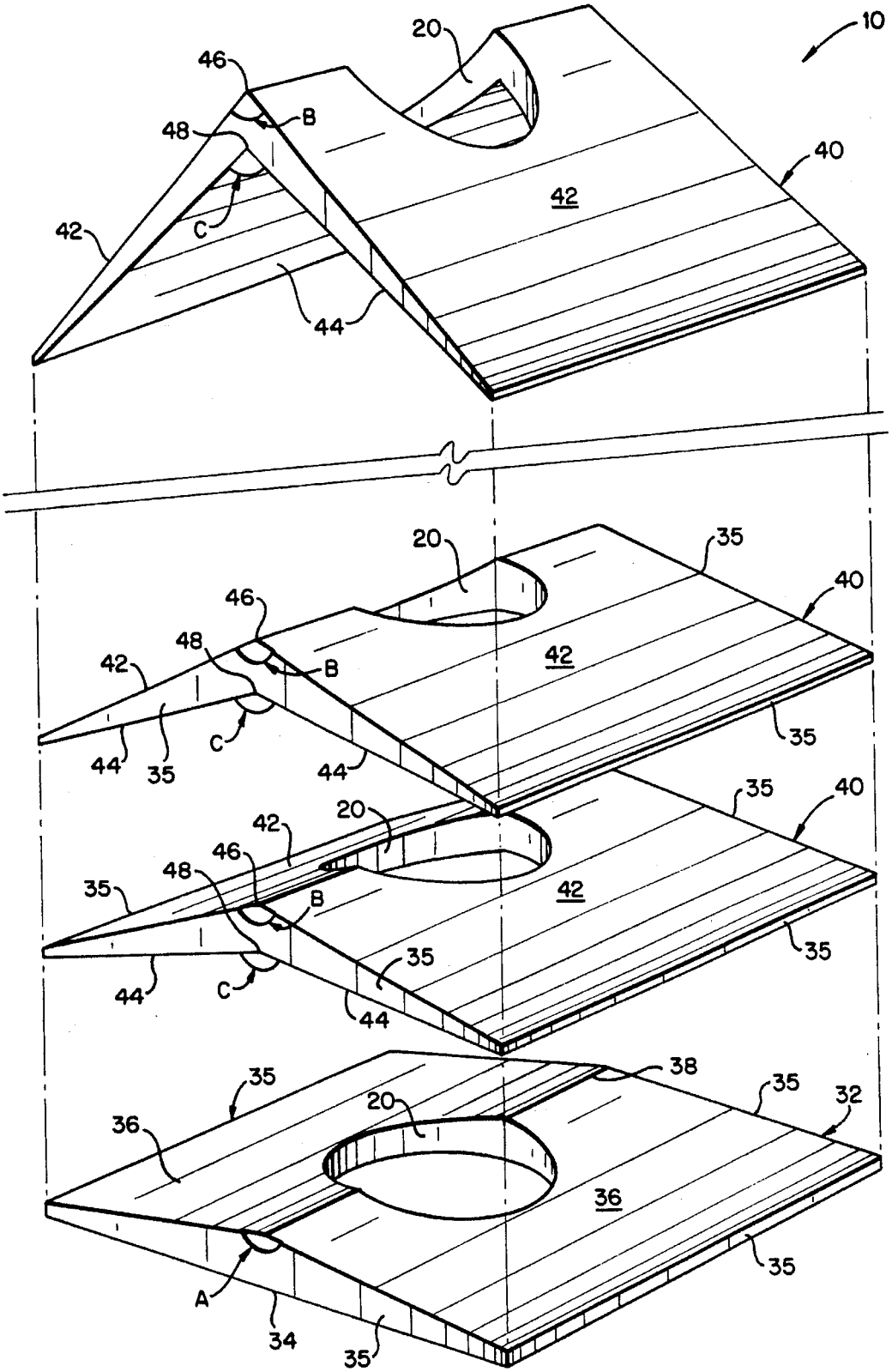
FIG. 3 is an exploded perspective view showing how the successive pitch mounts are stacked in one embodiment of the present invention.
Figure 4:
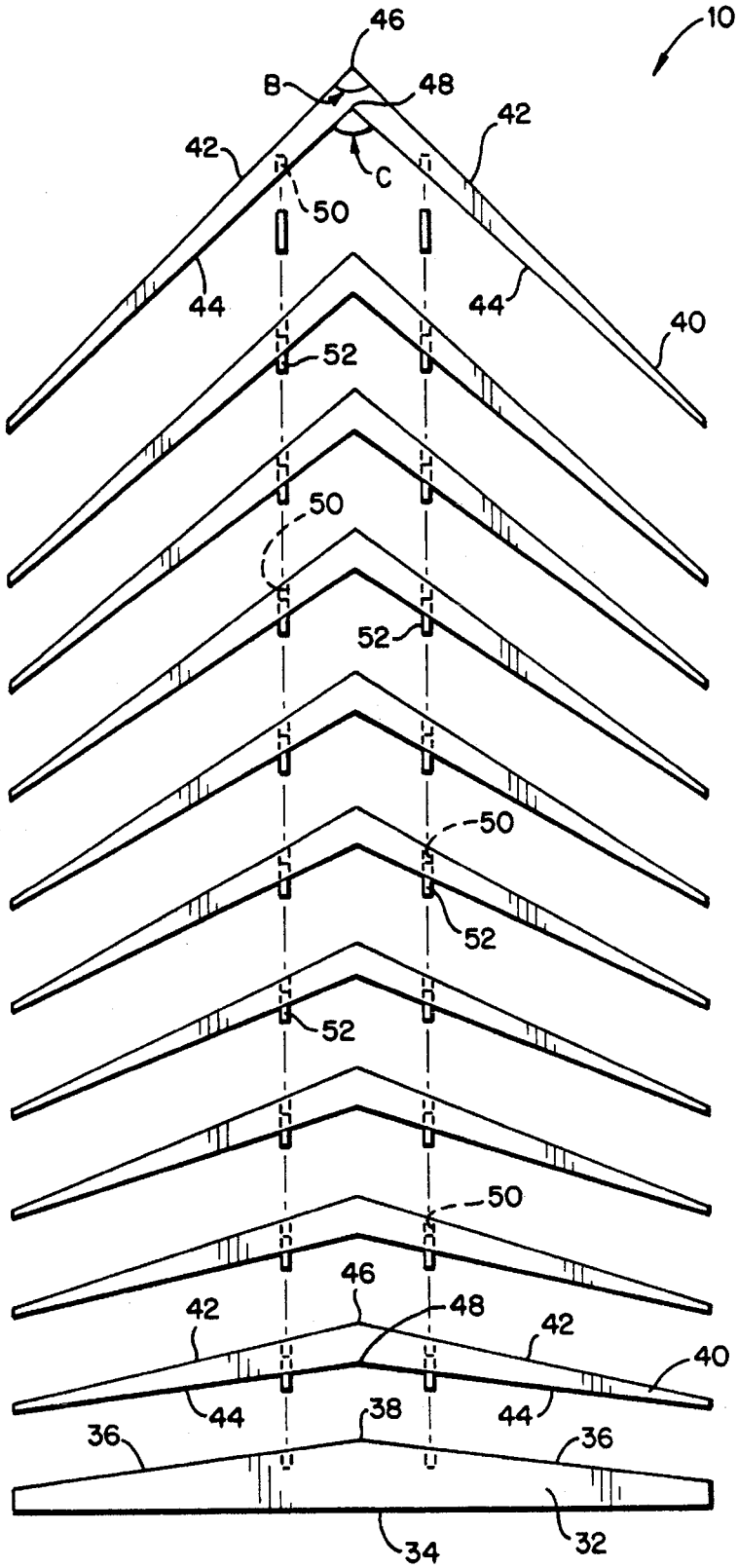
FIG. 4 is an exploded front view of the apparatus of the present invention showing a dowel method of attachment for the successive pitch mounts and base mount.

FIGS. 3 and 4 show another method of constructing the fixture mount 10 of the present invention. In FIGS. 3 and 4, there is shown a lower base mount member 32 having a flat, horizontal bottom surface 34 suitable for painting or other decoration to be viewed from below. Fixture boot 12 is mounted on bottom surface 34 when fixture mount 10 is installed as in FIG. 1. Base mount 32 is also provided with four vertical side faces 35 and two planar upper surfaces 36 which angle upwardly from the bottom surface 34 and meet at an apex 38 of the base mount 32. The angle "A" created at apex 38 should correspond to the lowest typical pitch angle used in cathedral ceilings. Since ceiling pitches are normally described in two-dimensional terms, the first pitch dimension as described herein is the height of the pitch at the apex and the second pitch dimension is the width of the pitch. For example, a ceiling pitch of 6×12 means that the horizontal distance from one truss member 15 to the other truss member 17 is twelve inches at a distance of six inches from the apex. In one embodiment of the present invention, the pitch of the base mount member 32 is 2×12.

Resting on top of the base mount 32 is an arrangement of successive pitch mounts 40. Each successive pitch mount 40 has a greater pitch angle than the pitch mount 40 located directly below. Each pitch mount 40 has two planar upper surfaces 42, two planar lower surfaces 44 and four side edges 35. The upper surfaces 42 of each pitch mount 40 meet at an upper apex 46 creating an upper apex angle "B" and the lower surfaces 44 meet at a lower apex 48 creating a lower apex angle "C". In one embodiment, the distance between upper apex 46 and lower apex 48 is one inch. However, this distance may vary in order to provide structural stability to the fixture mount 10 according to the type of material used.

The lower apex angle "C" of the lowest pitch mount 40 is identical to apex angle "A" of base mount 32. Thus, the pitch of the lower surfaces 44 of the lowest pitch mount 40 is the same as the pitch of base mount 32. This allows for flush contact between the lower surfaces 44 of the lowest pitch mount 40 and the upper surfaces 36 of base mount 32. With a single pitch mount 40 attached to base mount 32, the resulting fixture mount 10 is capable of fitting a higher ceiling pitch than with just the base mount 32 because the pitch has been increased according to the dimensions of the pitch mount 40. In one embodiment of the invention, the addition of the lowest pitch mount 40 to base mount 32 increases the pitch to 3×12.

The lower surfaces 44 of each successive pitch mount 40 provide flush contact with the upper surfaces 42 of each previous pitch mount 40 due to the lower apex angle "C" of each successive pitch mount 40 being identical to the upper apex angle "B" of each previous pitch mount. Also, the angle "B" of each successive pitch mount 40 will be less than that of the pitch mount 40 located below, thus increasing the pitch angle as additional pitch mounts 40 are installed. Thus, the addition of each successive pitch mount 40 increases the ceiling pitch which can be accommodated by the fixture mount 10 of the present invention. In one embodiment of the invention, a pitch at least as steep as 23×12 can be accommodated.

The attachment of each successive pitch mount 40 to each previous pitch mount 40 and to the base mount 32 can be accomplished in several ways. In the embodiment of the invention as shown in FIG. 4, the upper surfaces 42 of each pitch mount 40 except for the highest pitch mount 40 and the lower surfaces 44 of each pitch mount 40 as well as the upper surfaces 36 of the base mount 32 are all provided with dowel receivers 50 in the form of holes which allow for placement of dowels 52 which will prevent any shifting or sliding motion that might upset the flush appearance of the fixture mount 10. The dowels 52 are of appropriate size to maintain flush contact between the lower surfaces 44 and the upper surfaces 42 of consecutive pitch mounts 40.

Figure 6:
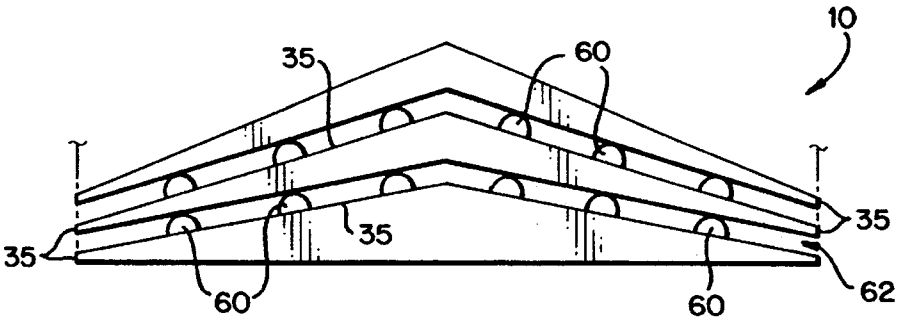
FIG. 6 shows an exploded front view of the apparatus of the present invention with pitch connectors being used to attach the successive pitch mounts and the base mount.

In the embodiment of the invention as shown in FIG. 6, pitch connectors 60 may be used instead of dowels 52 and dowel receivers 50. This embodiment allows the fixture mount 10 to be manufactured as a single piece of a lightweight foam material such as Styrofoam with the area 62 between pitch mounts 40 pre-cut with only small pitch connectors 60 of the same Styrofoam material near the side edges 35 of fixture mount 10 holding the fixture mount 10 together. In one embodiment, these pitch connectors 60 would act similar to perforated edges and could be cut away to the desired pitch with a utility knife or similar tool. Any pitch connectors 60 in the remaining portion of the fixture mount 10 being used could then be compressed when the fixture mount 10 is fastened securely to the ceiling workbox 24.

It is noted that FIGS. 4 and 6 are intended to be schematic representations showing specific features of the invention and an appropriate opening or bore such as bore 20 in the other drawings would allow the embodiments of FIGS. 4 and 6 to function in accordance with the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for providing a flush surface for a ceiling fixture at the ridge of a cathedral ceiling, comprising:

a base mount member having a planar lower surface and two planar upper surfaces which angle upwardly and meet at an apex to form a first pitch angle;

a pitch mount member having two planar lower surfaces which meet at an apex and two planar upper surfaces which meet at an apex to form a second pitch angle wherein said second pitch angle is steeper than said first pitch angle; and means for mounting said pitch mount member on said base mount member in a stacked configuration such that said planar lower surfaces of said pitch mount member abut the planar upper surfaces of said base mount member along the entire length thereof in substantially flush relation.

2. The apparatus of claim 1 wherein said pitch mount member is removably mounted on said base mount member.

3. The apparatus of claim 1 wherein dowels are employed to mount said pitch mount member on said base mount member.

4. The apparatus of claim 1 wherein pitch connector members are employed to connect the edges of said base mount member and said pitch mount member.

5. The apparatus of claim 1 wherein said base mount member has a central bore extending vertically therethrough.

6. The apparatus of claim 1 wherein said pitch mount member has a central bore extending vertically therethrough.

7. The apparatus of claim 1 wherein the distance between said apexes of said pitch mount member is constant throughout the length of said apexes.

8. The apparatus of claim 7 wherein said distance is one inch.

9. The apparatus of claim 1 wherein said pitch mount member includes a plurality of individual pitch mounts each having two planar lower surfaces which meet at an apex and two planar upper surfaces which meet at an apex to form a pitch angle steeper than said first pitch angle, said pitch mounts being mounted together in a stacked configuration such that said planar lower surfaces of each pitch mount abut the planar upper surfaces of the immediately adjacent underlying pitch mount along the entire length thereof in substantially flush relation.

10. The apparatus of claim 9 wherein said base mount member and said plurality of pitch mounts each include a central bore extending vertically therethrough.

* * * * *